US009360014B2

(12) United States Patent
Dorsch

(10) Patent No.: US 9,360,014 B2
(45) Date of Patent: Jun. 7, 2016

(54) CHOPPER PUMP WITH MIXING NOZZLES FOR A SEWAGE WET-WELL

(71) Applicant: Glenn R. Dorsch, Aberdeen, WA (US)

(72) Inventor: Glenn R. Dorsch, Aberdeen, WA (US)

(73) Assignee: Vaughan Company, Inc., Montesano, WA (US)

( * ) Notice: Subject to any disclaimer, the term of this patent is extended or adjusted under 35 U.S.C. 154(b) by 435 days.

(21) Appl. No.: 13/913,853

(22) Filed: Jun. 10, 2013

(65) Prior Publication Data

US 2013/0327405 A1 Dec. 12, 2013

Related U.S. Application Data

(60) Provisional application No. 61/658,133, filed on Jun. 11, 2012.

(51) Int. Cl.

| | |
|---|---|
| ***B02C 23/36*** | (2006.01) |
| ***F04D 7/04*** | (2006.01) |
| ***F04D 13/14*** | (2006.01) |

(52) U.S. Cl.

CPC ..... *F04D 7/045* (2013.01); *B02C 23/36* (2013.01); *F04D 13/14* (2013.01); *Y10T 137/0318* (2015.04); *Y10T 137/8376* (2015.04)

(58) Field of Classification Search

CPC ..... F04D 7/045; F04D 7/04; F04D 13/14; Y10T 137/0318; Y10T 137/8376; B02C 23/36

USPC ..... 241/46.01, 46.017

See application file for complete search history.

(56) References Cited

U.S. PATENT DOCUMENTS

| | | | | |
|---|---|---|---|---|
| 4,340,473 | A * | 7/1982 | Lindman | C02F 9/00 204/660 |
| 5,456,580 | A | 10/1995 | Dorsch | |
| 5,460,482 | A | 10/1995 | Dorsch | |
| 5,460,483 | A | 10/1995 | Dorsch | |
| 7,125,221 | B2 | 10/2006 | Dorsch | |
| 7,628,183 | B2 | 12/2009 | Dorsch | |
| 7,841,550 | B1 | 11/2010 | Dorsch | |
| 8,105,017 | B2 | 1/2012 | Dorsch | |
| 8,118,244 | B2 | 2/2012 | Dorsch | |
| 2003/0084693 | A1 * | 5/2003 | Sower | A23K 1/106 71/11 |
| 2011/0180633 | A1 | 7/2011 | Dorsch | |

* cited by examiner

*Primary Examiner* — Mark Rosenbaum
(74) *Attorney, Agent, or Firm* — Bishop Diehl & Lee, Ltd.

(57) ABSTRACT

Systems and methods for conditioning sewage having entrained solids which clog sewage pumps, are disclosed. Systems include a sewage pump, a chopper pump, and a mixing nozzle connected to the chopper pump. Specifically, the sewage pump is a non-clog centrifugal pump having an inlet for drawing fluid into the pump and an outlet for discharging the fluid into a pipe, while the chopper pump has an inlet for drawing fluid into the pump and an outlet for discharging the fluid into the wet-well. The chopper pump may be positioned either in or adjacent to the wet-well. The mixing nozzle fluidly coupled to the chopper pump discharge, is positioned in the wet-well. Methods include the steps of positioning a chopper pump within the wet-well, drawing in liquid sewage, including the entrained solids, reducing the size of entrained solids, and discharging the sewage and reduced size solids into the wet-well.

15 Claims, 2 Drawing Sheets

CHOPPER PUMP WITH MIXING NOZZLES FOR A SEWAGE WET-WELL

RELATED APPLICATIONS

The present application claims the filing priority of U.S. Provisional Application No. 61/658,133 titled "Chopper Pump With Mixing Nozzles For A Sewage Wet-Well" and filed on Jun. 11, 2012 in the name of assignee Vaughan Company. The '133 application is hereby incorporated by reference.

TECHNICAL FIELD OF THE INVENTION

The present system relates to methods and devices for reducing solid debris and floating material within a sewage wet-well. Particularly, the present system relates to the use of smaller flow chopper pumps to condition debris within a sewage wet-well to prevent clogging of larger flow pumps.

BACKGROUND OF THE INVENTION

Pumping stations in sewage collection systems, also called lift stations, are normally designed to handle raw sewage that is collected and fed from underground gravity pipelines. Sewage is fed into and stored in an underground pit, commonly known as a wet well. The well is equipped with electrical instrumentation to detect the level of sewage present. When the sewage level rises to a predetermined point, a large pump (or pumps) begins to operate to lift the sewage upward through a pressurized pipe system called a sewer force main or rising main from where the sewage is discharged into a gravity manhole. From here the cycle starts all over again until the sewage reaches its point of destination—usually a sewage treatment plant. By this method, pumping stations are used to move waste when necessary to higher elevations.

The criticality of the proper operability of these large sewage pumps cannot be overstated. If a pump should become inoperable due to clogging by sewage debris, for example, a backup in the sewer system can occur, leading to a sanitary sewer overflow—i.e., the discharge of raw sewage into the environment. This scenario occurs too frequently, leaving those in the field looking for an effective means to prevent such discharge.

The sewage pumps most commonly used are end-suction centrifugal pumps with "non-clog" impellers. A "non-clog" impeller is designed to pass a specific sized sphere, for example a three-inch diameter sphere. While these pumps are specially designed with a large open passage so as to avoid clogging with debris or the winding stringy debris onto the impeller, such clogging nevertheless occurs. When the clogging does occur, the pump may bind causing an overload at the pump power source. This could trip the power off, which may further complicate the potential pump problem.

These and other problems are addressed by the present system, devices and methods. Where others have failed to appreciate the problem or have overlooked the solution, the present system provides numerous advantages in operation and effectiveness.

SUMMARY OF THE INVENTION

A system and methods for conditioning sewage in a sewage wet-well, are disclosed. The system and methods facilitate prevention of clogging of a sewage pump positioned within a sewage wet-well where sewage, which is substantially a liquid with entrained solid matter, is collected and held before transporting to a sewage treatment facility.

Generally speaking, the system comprises a sewage pump, a chopper pump, and a mixing nozzle connected to a outlet of the chopper pump. In a particular embodiment of the system, the sewage pump is a "non-clog" impeller centrifugal pump having an inlet for drawing fluid into the pump and an outlet for discharging the fluid into a pipe, while the chopper pump has an inlet for drawing fluid into the pump and an outlet for discharging the fluid into the wet-well. The chopper pump may be positioned either in or adjacent to the wet-well. The mixing nozzle fluidly coupled to the chopper pump discharge, is positioned in the wet-well.

In an embodiment of the system, the mixing nozzle is directly attached to the chopper pump and is positioned to direct the sewage discharge within the sewage to create mixing. A plurality of mixing nozzles may be arranged within the wet-well to create a mixing flow within the sewage.

Generally speaking, the method for reducing clogging of a sewage pump by solids entrained in substantially liquid sewage being collected in a sewage wet-well for pumping to a sewage treatment facility, comprises the steps of positioning a chopper pump having an inlet and an outlet within the wet-well, drawing liquid sewage, including the entrained solids, into the inlet of the chopper pump, reducing the size of any entrained solids in the sewage drawn into the chopper pump which might cause clogging in the sewage pump, and discharging the drawn sewage and reduced size solids from the chopper pump into the wet-well.

In a specific embodiment of the method, the chopper pump discharge is used to mix the sewage in the wet-well. Accordingly, mixing nozzles coupled to the outlet of the chopper pump are used.

Additional aspects and advantages of the invention can be understood from a reading of the following detailed description accompanied by the appended drawing figures.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF PREFERRED EMBODIMENTS

Figure 1:
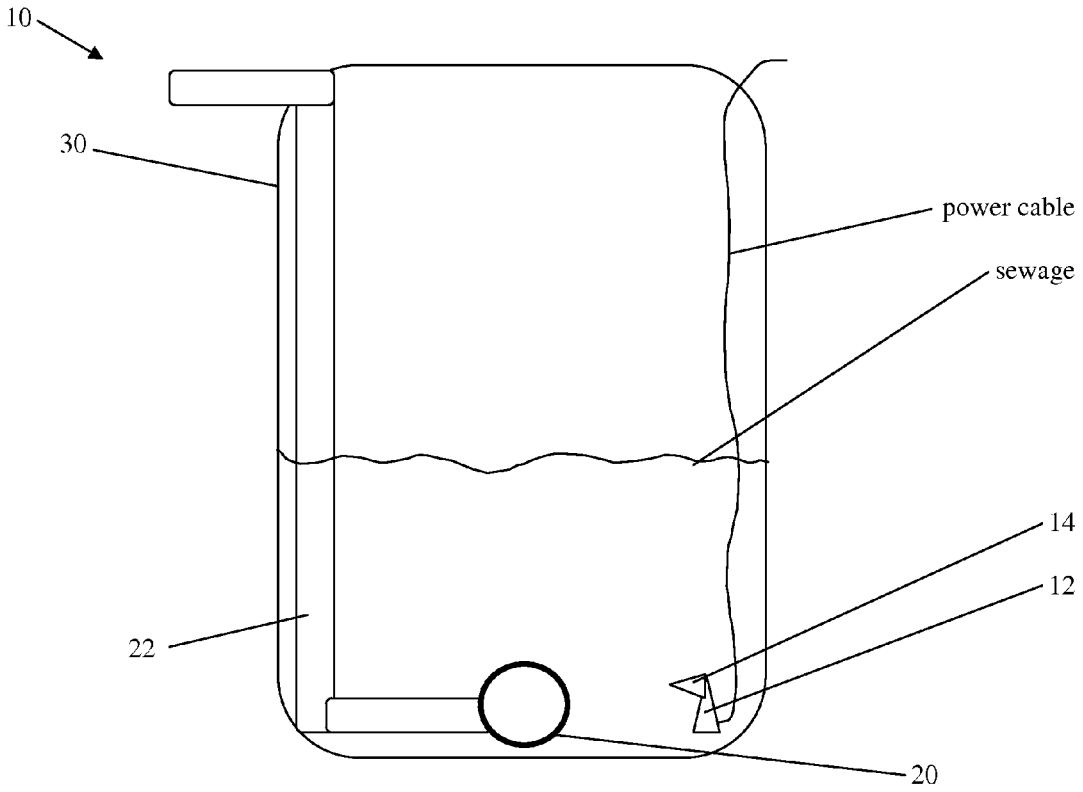
FIG. 1 is a side view of an embodiment of the present system in a sewage wet-well.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

Figure 2:
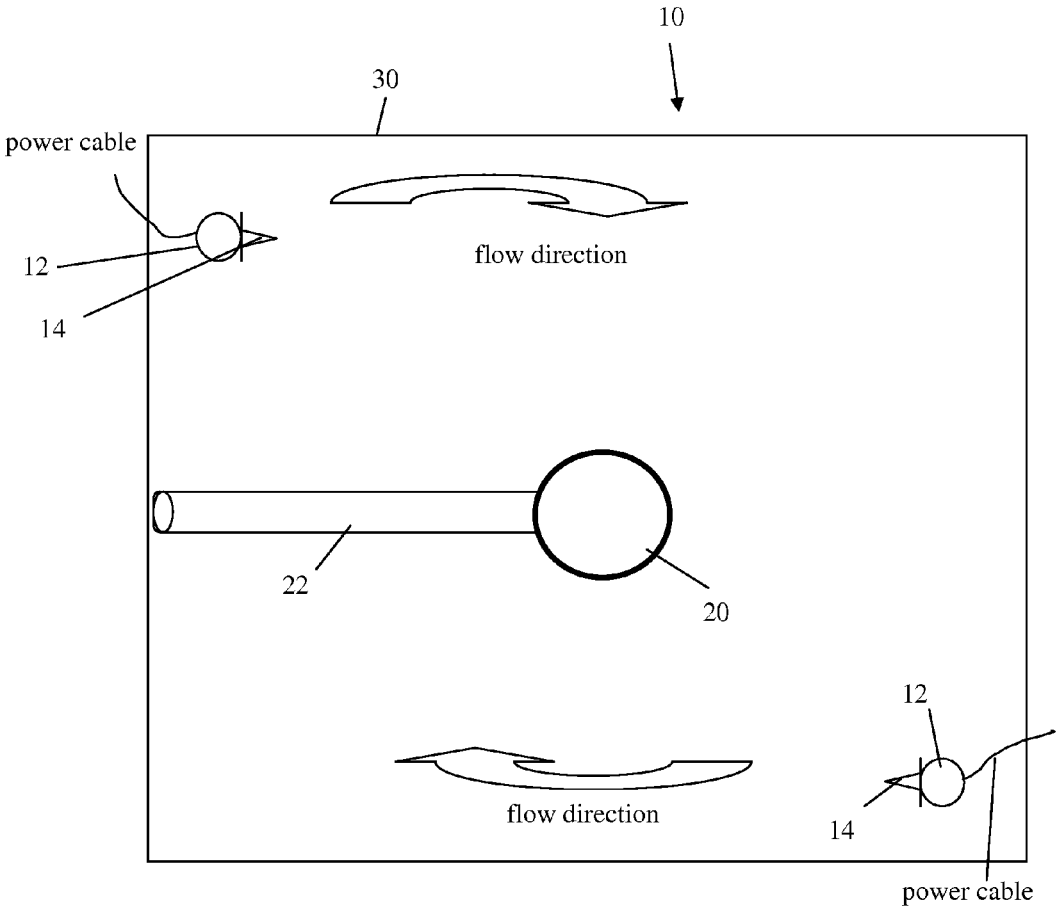
FIG. 2 is a top view of the embodiment of FIG. 1.

With reference to the illustrations of FIGS. 1 and 2, an embodiment of a sewage conditioning system, generally referenced by the numeral 10, is shown and described below. The system 10 is used for reducing the size of solid debris entrained within the sewage, which is collected and stored in a wet-well, in order to facilitate pumping by larger flow (or sewage) pumps 20. Without such conditioning of the sewage, the larger pump(s) 20 may become clogged with the solid debris typically entrained in the sewage. By "conditioning" it is meant that the sewage, and particularly any solid debris within the sewage, is subjected to physical treatment to reduce the likelihood of clogging in sewage pump 20 and sewage discharge pipes 22.

The need for the present system 10 in municipal wet wells occurs for at least one of two reasons: (1) municipalities are unable to replace existing sewage pumps; and (2) existing chopper pumps are unable to create the needed head or flow. As to the first reason, municipalities often operate on a tight budget and sufficient funds may not be available to invest in a brand new sewage pump system, or when a municipality does invest in expensive new sewage pumps, they may not work as reliably because of plugging problems. As to the second issue, even where a municipality might be willing and able to scrap out older sewage pumps that are constantly plugging, chopper pumps of the requisite flow capacity (i.e., generate the needed head or flow) or that are large enough to replace the original pumps, do not exist. Some municipality sewage pumps are much larger than chopper pumps currently available.

In both scenarios the problem can be resolved by leaving in the current large sewage pump(s) 20 and adding at least one chopper pump 12 to condition the sewage by minimizing the size of solid material, thereby reducing if not eliminate the clogging problem. To do this, a submersible chopper pump 12 having a nozzle 14 affixed to the discharge is placed within a sewage lift station wet-well 30 to chop-up and mix-up debris so that the larger pumps 20 already installed in the station can handle this debris without plugging.

Specifically, in these situations, at least one chopper pump 12, most preferably a submersible chopper pump, such as those designed, manufactured and sold by Vaughan Co., Inc. of Montesano, Wash. (http://www.chopperpumps.com), with a single nozzle 14 mounted on the pump discharge maybe strategically placed within the well 30. Alternatively, a self-priming or horizontal chopper pump, such as those designed, manufactured and sold by Vaughan Co., Inc., mounted outside the pit with one or two nozzles located in the pit may be used.

In either case, the idea is to continuously mix up grit within the sewage liquid and chop up floating debris so that existing sewage pumps 20 will work reliably without plugging. The continuous chopping is provided by the use of at least one chopper pump 12. Exemplary chopper pumps and chopper pump features may be found in U.S. Pat. Nos. 8,118,244, 8,105,017, 7,841,550, 7,125,221, 5,460,483, 5,460,482, and 5,456,580, each of which is hereby incorporated by reference. The chopper pump 12 operates to reduce the size of solid debris, while continuous mixing is accomplished by the use of a mixing nozzle 14 attached to the chopper pump 12. Exemplary nozzles are described in U.S. Pat. No. 7,628,183 and U.S. Published Application No. 2011/0180633, both of which are hereby incorporated by reference.

The nozzle 14 may be directed in a manner which is most efficient and effective at mixing the sewage to prevent settling of grit and other materials in the well 30. With reference to FIG. 2, the use of multiple nozzles 14 aimed to promote clockwise (or counter-clockwise) mixing of the sewage is preferred, especially in larger wells. As the pit collects grit, which tends to settle out of the liquid in the well 30, continuously mixing up the sewage helps to keep the grit entrained so that it is pumped out via the sewage pump 20. Without this mixing, the wet-well 30 would begin to fill up with grit which then requires the pit to be pumped and cleaned out on a regular basis by a vacuum truck. Pumping out the well 30 of settled grit is an expensive undertaking for a municipality. However, without removal of the grit, the well becomes overburdened and damage to the sewage pump 20 may result.

The arrangement and number of chopper pumps 12 and mixing nozzles 14 may depend on the size and shape of the wet-well pit 30. Further, while the chopper pumps 12 and nozzles 14 are shown to be exclusively positioned on the pit bottom, it may be useful in some applications to have some or all nozzles 14 positioned significantly above the pit floor. Other alterations, changes and modifications may be made as to the arrangement and The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A system for conditioning sewage in a sewage wet-well, the system comprising:

at least one sewage pump positioned within a wet-well and having an inlet for drawing fluid into the pump and an outlet for discharging the fluid from the wet-well;

a chopper pump having an inlet for drawing fluid from the wet-well into the pump and an outlet for discharging the fluid into the wet-well, the chopper pump being positioned either in or adjacent to the wet-well; and a plurality of mixing nozzles fluidly coupled to the chopper pump discharge, wherein the mixing nozzles are positioned in the wet-well and arranged to create a mixing flow within the sewage.

2. The system of claim 1, wherein the chopper pump is a submersible pump positioned within the wet-well.

3. The system of claim 1, wherein the chopper pump is a recirculating pump positioned within the wet-well.

4. The system of claim 3, wherein the mixing nozzle is attached to the recirculating pump.

5. The system of claim 1, wherein the mixing nozzle is directly attached to the chopper pump.

6. The system of claim 1, wherein the sewage pump comprises an non-clog centrifugal pump.

7. The system of claim 1, further comprising a discharge pipe connected to the sewage pump outlet, wherein the discharge pipe directs the sewage out of the wet-well.

8. A system for conditioning sewage, the system comprising:

a sewage wet-well for collecting and storing sewage to be pumped to a sewage treatment facility, wherein the sewage is substantially liquid with solid material therein;

at least one sewage pump positioned within the sewage wet-well having an inlet for drawing fluid into the pump and an outlet for discharging the fluid, wherein the discharged fluid is carried out of the wet-well;

a chopper pump having an inlet for drawing fluid from the wet-well into the pump and an outlet for discharging the fluid back into the wet-well, the chopper pump being positioned either in or adjacent to the wet well; and a plurality of mixing nozzles fluidly coupled to the chopper pump discharge, wherein the mixing nozzles are positioned submersed in the wet-well and are arranged to create a mixing flow within the sewage.

9. The system, of claim 8, wherein the chopper pump is a submersible pump positioned within the wet-well.

10. The system of claim 8, wherein the chopper pump is a recirculating pump positioned, within the wet well.

11. The system of claim 10, wherein the mixing nozzle is directly attached to the recirculating pump.

12. The system of claim 8, wherein the mixing nozzle is directly attached to the chopper pump.

13. A method for reducing clogging of a sewage pump by solids entrained in substantially liquid sewage being collected in a sewage wet-well for pumping to a sewage treatment facility, the method comprising the steps of:

positioning a chopper pump having an inlet and an outlet within a wet-well having a sewage pump positioned within for discharging solids-entrained liquid sewage from the wet-well;

drawing the liquid sewage, including the entrained solids, into the inlet of the chopper pump;

reducing the size of any entrained solids in the liquid sewage drawn into the chopper pump which might cause clogging in the sewage pump; and discharging the drawn sewage and reduced size solids from the chopper pump into the wet-well through a plurality of mixing nozzles arranged to create a mixing flow within the sewage.

14. The method of claim 13, further comprising the step of using the chopper pump discharge to mix the sewage in the wet-well.

15. The method of claim 14, further comprising mixing nozzles coupled to the outlet of the chopper pump.

* * * * *